United States Patent [19]

Bäcker et al.

[11] 4,103,404

[45] Aug. 1, 1978

[54] NOZZLE DEVICE FOR THE PRODUCTION OF TEXTURIZED FILAMENT YARNS

[75] Inventors: Wolfgang Bäcker, Dormagen; Heinzbert Wojahn, Monheim; Hans-Theo Esser, Cologne; Karlheinz Feltgen, Dormagen; Roland Weisbeck, Odenthal, all of Fed. Rep. of Germany

[73] Assignee: Bayer Aktiengesellschaft, Leverkusen, Fed. Rep. of Germany

[21] Appl. No.: 814,651

[22] Filed: Jul. 11, 1977

[30] Foreign Application Priority Data

Jul. 13, 1976 [DE] Fed. Rep. of Germany ..... 2631393

[51] Int. Cl.[2] ..... D02G 1/12; D02G 1/16

[52] U.S. Cl. ..... 28/255; 28/263

[58] Field of Search ..... 28/254, 255, 256, 271, 28/263, 268, 267; 57/34 B, 157 P

[56] References Cited

U.S. PATENT DOCUMENTS

| | | | |
|---|---|---|---|
| 2,807,862 | 10/1957 | Griset | 28/254 |
| 3,256,582 | 6/1966 | Burleson | 28/255 |
| 3,296,677 | 1/1967 | Chase | 28/255 |
| 3,343,240 | 9/1967 | Parmeggiani et al. | 28/255 |
| 3,409,956 | 11/1968 | Longbottom et al. | 28/255 |
| 3,580,445 | 5/1971 | Moore | 28/255 |
| 3,643,843 | 2/1972 | Havias et al. | 28/272 X |
| 3,874,045 | 4/1975 | Butler et al. | 28/255 |
| 3,895,420 | 7/1975 | Strutz et al. | 28/255 |
| 3,983,610 | 10/1976 | Eskridge et al. | 28/265 |

FOREIGN PATENT DOCUMENTS

| | | | |
|---|---|---|---|
| 1,435,647 | 2/1969 | Fed. Rep. of Germany | 28/254 |
| 4,522,907 | 7/1970 | Japan | 28/254 |
| 1,161,674 | 8/1969 | United Kingdom | 28/255 |

*Primary Examiner*—Louis K. Rimrodt
*Attorney, Agent, or Firm*—Plumley and Tyner

[57] ABSTRACT

The invention relates to a nozzle device for texturizing filament yarns of synthetic, high molecular weight substances by means of a hot medium comprising heated gases or vapors, comprising three chambers arranged on after another, a first chamber through which the hot medium flows into a second chamber, the yarn being drawn into the second chamber at an angle to the direction of flow of the gaseous medium, the yarn being heated by the gaseous medium in the second chamber, and a third chamber in which the thread is compressed with the formation of plugs, the compression chamber being formed of a plurality of elastically flexible rods which are arranged on the surface of a right circular cylinder or a right circular truncated cone and fixed at one end on the end of the second chamber, the rods being of two different lengths.

11 Claims, 7 Drawing Figures

NOZZLE DEVICE FOR THE PRODUCTION OF TEXTURIZED FILAMENT YARNS

Figure 1:
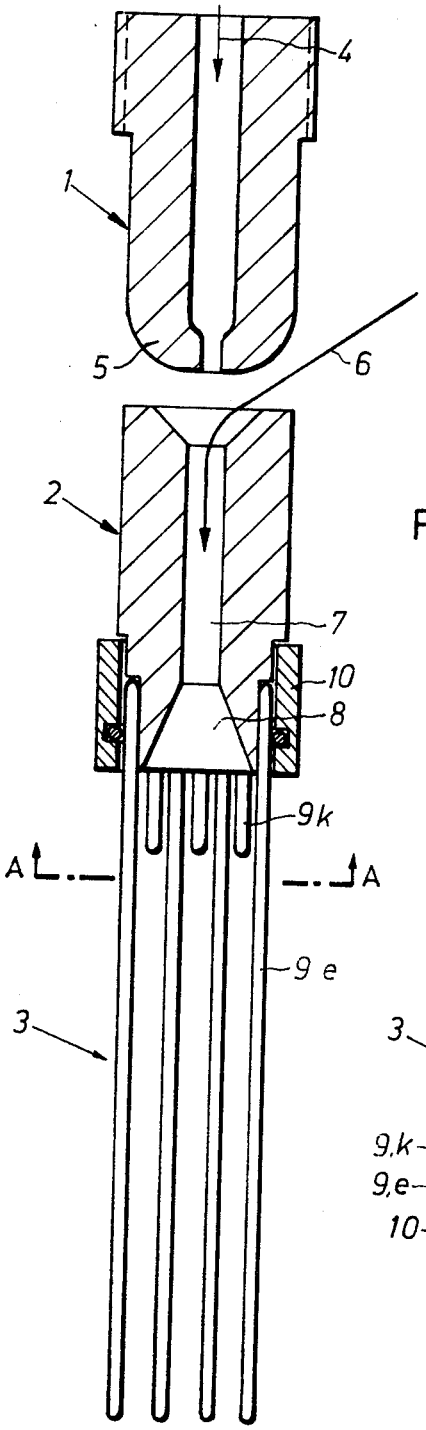

The invention relates to a nozzle device for the production of texturised filament yarns from synthetic high molecular weight substances by means of flowing heated gases or vapours also disclosed in copending application Ser. No. 730,299 (now abandoned).

Nozzle devices for texturising filament yarns are already known. These devices may be roughly divided into two groups. To the first group belong devices having axial thread feed, wherein the heated gaseous medium either flows onto the threads through oblique bores or through a coaxial slit. The second group comprises devices having axial supply of the gaseous medium and diagonal supply of the thread, that is, forming an angle which is generally between 0° and 90°, to the axis of the device.

Devices of the first group have the advantage that they afford good texturising, that is good crimping high number of crimps and good crimping stability and also partly form a satisfactory thread end. However, it is disadvantageous that these devices do not usually draw in the threads themselves. Laying on may usually only be carried out with auxiliary devices. This is complicated at high thread speeds and even impossible with some devices.

Devices of this type therefore require longer laying on times and are only suitable for use at high speeds under certain conditions, sometimes not at all. In stretch spinning texturising, long laying on times are synonymous with high material wastage. Devices of the first group therefore impair the economy of the texturising process.

Another drawback is that only the axial component of the impulse of the gas or steam stream is available for transporting the threads through the nozzle. However, in order to achieve the transportation of the threads, small bores or narrow slits must be used for supplying the gaseous medium to the thread. This means, on one hand, precision mechanics leading to high production costs, and on the other hand, the risk of adjustment effects, since certain tolerances may not be fallen short of in dimensional accuracy. Below these, the uniformity of the product's quality suffers.

Devices of the second group have the great advantage with regard to handling, that they draw in the thread themselves. Thus, laying on may be carried out very rapidly with a single suction gun without an auxiliary device. This is also valid at high speeds, for example at 2000 m/min. However, a disadvantage is that both the degree of texturisation and the thread end of the texturised thread are only moderate. Handling and construction of the devices of the second group are simple. Indeed, this leads to high economy in the texturising process, but does not produce the desired product quality.

The object of the present invention is to provide a texturising nozzle which unites the advantages of simple handling and simple construction, on one hand, and good texturised quality as well as good thread end on the other hand.

This object is accomplished by a nozzle device for the production of texturised filament yarns from synthetic, high molecular weight substances by means of heated gases or vapours, comprising three chambers arranged one behind the other, the hot medium in the form of gas or vapour flowing into one section in its first chamber and the thread being sucked at an angle to the direction of flow in the second section, the thread being heated by the hot medium in the second chamber and the thread being compressed with the formation of plugs in the third chamber, wherein the compression chamber is formed from elastically soft flexible rods which are arranged on the surface of a right circular cylinder or a right circular truncated cone and fixed at one end on the end of the second chamber, said compression chamber being formed from rods of two different lengths *e* and *k*.

Until now, the hot gas or hot water vapour was always blown in exactly axially in conventional texturising nozzles of the second group, in order to utilise the entire flow impulse for transporting the thread. A circular cylindrical pipe having a diameter of some 10 to 12 mm was used as a compression pipe. The pipe edge was perforated in some positions or slit along a line on the margin, so that the hot gas or the hot steam could escape. Glass or stainless steel were used as pipe materials. The internal wall of the compression pipe had to be subjected to a specific surface treatment. Yarn plugs could no longer be afforded with certainty at yarn titres $> 1000$ dtex with an internal diameter below some 10 mm. In order to attain a degree of texturising which was constant with time, care had to be taken that the length of the plug was kept constant with time. This may be achieved for example by pneumatic regulation.

Contrary to this knowledge based on experiments about the desired working conditions, it has been revealed that a plug yield may also be obtained with substantially smaller compression pipe diameters, if a series of rods of different lengths is used according to the invention instead of a pipe, these rods being arranged on the surface of a right circular cylinder or a right circular truncated cone. This type of rod arrangement surprisingly gave a degree of texturisation which was even better than the conventional suction pipe, since both an increased crimping and a higher number of crimps are obtained. It was also found that the formation of the yarn plug and the removal of the plug was improved by the generation of a non-axially symmetrical flow of the hot gas or steam directly before the thread sucking in point (that is, at the end of the first of the three chambers) and by mounting the rods which form the compression chamber on one side only at the end of the second chamber as well as by using elastic, soft flexible rods.

Although a compression chamber which only comprises elastic, soft flexible rods which are mounted at one end gives an unstable impression, such an arrangement possesses several advantages. The packing density of the yarn plug remains practically constant since the elastic soft flexible rods can easily give way to each pressure of the plug so that an increase in pressure of the plug manifests itself in an increase in the volume of the plug. Constant packing density signifies constant texturising quality and the avoidance of snags and loops which may easily be formed by hooking inside a plug which is too dense when the plug is removed to the thread. Whereas in conventional compression pipes a regulation of the plug length or plug position is required or is very advantageous, regulation from outside is superfluous here since the rod system keeps the length of the plugs or the position of the plugs sufficiently constant.

A non-axially symmetrical flow of the hot gas or steam may be generated according to the invention:

1. By arranging a non-axially symmetrical throat or extension in the supply bore directly upstream of the position where the thread is drawn in;

2. By incorporating at least one slit with rectangular cross section which opens into the hole just upstream of the position where the thread is drawn in, wherein, for the slit width *b*, based on the narrowest diameter *d* of the hole, the relationship $0.1\ d \leqq b \leqq 0.5\ d$ is valid;

3. By installing a twisting body in the hole directly upstream of the position where the thread is drawn in; and 4. By installing an additional part just upstream of the position wher the thread is drawn into the bore, wherein this additional part contains at least two smaller bores and wherein none of the axes of these smaller bores is coplanar with the axis of the large bore. For example, the axes of the smaller bores may coincide with tangents to a helical line which is coaxial with the axis of the larger bore. The sum of the cross-sectional areas of the smaller bores should be approximately equal to the cross-sectional area of the larger bore.

All four of the above mentioned measures for producing a non-axially symmetrical flow according to the invention are equal in their effectiveness. The production cost in the second and fourth arrangements is somewhat lower.

The device according to the invention contains two novel features, namely the non-axially symmetrical flow of the hot gas or vapour directly upstream of the position where the thread is drawn in (feature 1) and the nozzle compression chamber, comprising rods which are arranged in a specific manner (feature 2).

The new texturising nozzle according to the invention, without the feature "non-axially symmetrical flow", also brings a marked improvement in the degree of texturisation and of the thread end after removal of the yarn plug to the thread downstream of the texturising nozzle. Also with axially symmetrical flow upstream of the position where the thread is sucked in, the new compression chamber brings about a great technical advance which is revealed in the products higher quality. By producing a non-axially symmetrical flow, the positive effect of the nozzle compression chamber on the quality of product is clearly increased. The non-axially symmetrical flow thus provides a pure strengthening effect, which does not bring any noteworthy improvement in the quality of the product with the conventional compression pipe. To summarise, it may be stated: the feature 2 of the invention, taken by itself, represents an unequivocal technical improvement, which is increased by feature 1. However, feature 1 alone, that is without feature 2, does not bring about a noteworthy technical improvement.

The compression chamber according to the invention may be constructed in various manners. A large advantage of this compression chamber which comprises rods which are fixed on one side, is that the geometry, within certain limits, has no decisive influence on the operating manner. Thus it has been shown that by arranging the rods on the surface of a right circular cylinder, the length of the chamber or the rods 1 may be varied between some 30 and 300 m, the chamber internal diameter between some 2.5 and 10 mm, without the texturising yield being influenced to a noteworthy degree. However, chamber lengths of between some 100 and 200 mm and chamber internal diameters of between 3 and 7 mm are normally preferred. The rods may also be arranged on the surface of a right circular truncated cone, wherein the angle of the surface lines with respect to the base (the clamping surface of the rods) should be larger than around 80° and smaller than 110°. Angles between approximately 80° and approximately 90° appear to be the most favourable for yarn titres (texturised titres) in the range of 1000 to 300 dtex. The cross-sectional shape of the rods does not have a noticeable influence on the quality of the yarn, providing sharp edges and scratches are avoided on the surface of the rods. However, it is simplest to use rods having a circular cross-section. A diameter of between approximately 1 and 3 mm is suitable for such rods. The interval between each pair of adjacent rods is 0.2 to 1.5 mm on the point of fixing it should be large enough for the heated medium in the form of gas or vapour to be able to flow out between the rods easily, even during elastic deformation of the rods - but not so large that the yarn plugs squeeze out between the rods.

The arrangement of the rods forming the compression chamber is essential for the device according to the invention. It consists in the compression chamber being formed from rods of two different lengths (*e* and *k*). A long (1 = chamber length) and a short (*k*) rod are appropriately arranged alternatively, wherein for the ratio $e/k$: $2 \leqq e/k \leqq 50$ is valid.

The advantage of such an arrangement consists in the compression chamber being divided into two sections, in whose first section plugs are formed through the pressure of *e* and *k* rods, and in whose second section (only *e* rods) the plug output is simplified and the flexible elastic behaviour of this section of the chamber becomes softer.

The drawing-in tension of the thread upstream of the texturising nozzle may be increased, particularly by these measures.

The material used for the rods and the surface structure of the rods only have secondary importance, providing sharp edges and scratches are avoided and that wear resistant materials are used to a certain extent from the outset. The wear resistant requirements are not so high that a ceramic component, from $Al_2O_3$ etc. for example, is necessary. Normal commercial filler rods have proved to be good as rods. Their wear resistance and their surface structure are adequate. It is expedient to arrange the rods in such a way that they may be easily exchanged. By using inexpensive rods, it is simpler and cheaper to exchange damaged or soiled rods, than to process or clean them. It is even simpler and more expedient and safer to mount all the rods firmly on a crown so that the compression chamber according to the invention represents a complete, inexpensive unit which may be fixed as an entity on the second chamber of the texturising nozzle and easily be exchanged if necessary.

For economic reasons, heated air and superheated steam are primarily used as the heated gases or vapours. For texturising polyamide filament yarns, super-heated steam gives somewhat better results, particularly with regard to the uniformity of texturisation. Suitable pressures for the super-heated steam are in the range of between 3 and 10 bar. The substance ratio steam/thread should be between 0.2 and 0.5.

The device according to the invention for texturising filament yarns, in particular polyamide yarns may particularly advantageously be used for the carpet industry.

It has also been shown that polyester filament yarns, for example, having textile titres (167 dtex) may also be texturised in the device according to the invention at high speeds (3000 m/min) with high yield. With textile titres, the internal diameter of the compression chamber is preferably in the region of 3 mm.

Figure 2:
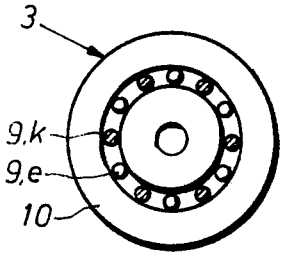
Figure 3:
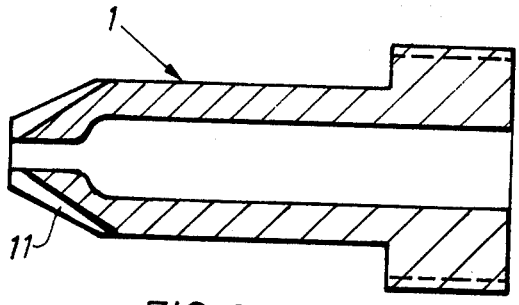
Figure 4:
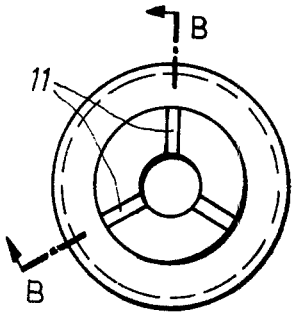
Figure 5:
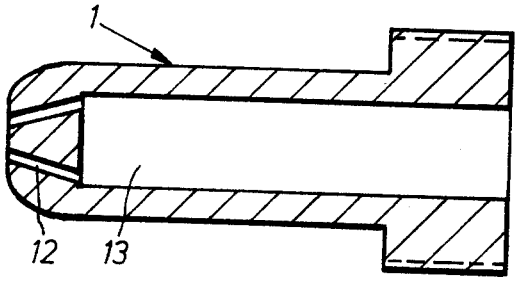
Figure 6:
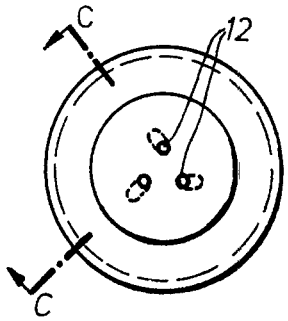
Figure 7:
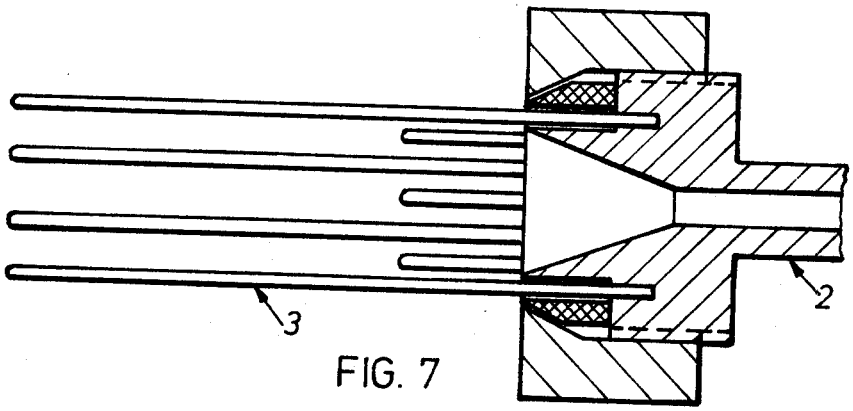

In the accompanying drawings,

FIG. 1 shows a schematic representation of an embodiment of the device (according to the invention) comprising three chambers, FIG. 2 shows a sectional drawing of the compression chamber of the device of FIG. 1, FIGS. 3 and 4 show an embodiment of the first chamber with three rectangular slits upstream of the position where the thread is sucked in (the slit in two views), FIGS. 5 and 6 show another embodiment of the first chamber with an additional part directly upstream of the position where the thread is sucked in, which contains three small bores, wherein none of the axes of these small bores is coplanar with the axis of the large bore (the small holes in two views), and FIG. 7 shows an embodiment of the third chamber (compression chamber) with a device holding the compression chamber at the end of the second chamber.

The device according to FIG. 1 comprises the three chambers 1, 2 and 3. The hot gas or vapour 4 flows axially into the chamber 1, which has an insert 5 at its end for producing a non-axially symmetrical flow. The thread 6 is sucked in tightly downstream of chamber 1 or the insert 5 and warmed in the chamber 2 by the hot gaseous medium. The chamber 2 comprises a bore 7 which extends to a funnel 8, which serves as a transition from the smaller bore 7 to the diameter of the chamber 3 (compression chamber). The compression chamber 3 comprises 12 cylindrical, elastic soft flexible steel rods 9*k* and 9*e* of two different lengths *k* and *e*, which are fixed equidistant at the end 10 of the chamber 2. In FIGS. 3 and 4, three rectangular slits 11 are arranged in the shape of a star in the chamber 1, in order to produce the non-axially symmetrical flow.

In FIGS. 5 and 6, three small bores 12 are arranged at the end of the chamber 1. None of the axes of these bores is coplanar with the axis of the large bore 13. In addition the axes of the bores 12 are at different angles to the cross-sectional plane (perpendicular to the axis of the bore 13), and to the associated (that is, cutting the axis) radial flow within a cross-sectional plane perpendicular to the axis of the bore 13.

We claim:

1. Nozzle device for the production of texturised filament yarns from synthetic, high molecular weight substances by means of heated gases or vapours, comprising three chambers arranged one behind the other, the hot medium in the form of gas or vapour flowing into one section in its first chamber and the thread being sucked at an angle to the direction of flow in the second section, the thread being heated by the hot medium in the second chamber and the thread being compressed with the formation of plugs in the third chamber, wherein the compression chamber is formed from elastically soft flexible rods which are arranged on the surface of a right circular cylinder or a right circular truncated cone and fixed at one end on the end of the second chamber, said compression chamber being formed from rods of two different lengths *l* and *k*.

2. Device according to claim 1, wherein the bore has a mouth piece for supplying the medium in the form of a gas or vapour to the first chamber just upstream of the position where the thread is drawn in, this mouth piece producing a non-axially symmetrical flow.

3. Device according to claim 2, wherein the first section of the first chamber comprises a bore, which has at least one non-axially symmetrical throat or extension at its end, upstream of the position where the thread is drawn in.

4. Device according to claim 2, wherein the first section of the first chamber comprises a bore, on the end of which at least one slit with rectangular cross-section, upstream of the position where the thread is drawn in, opened into the bore, wherein for the slit width *b*, based on the narrowest diameter *d* of the bore, $0.1\ d \leqq b \leqq 0.5\ d$ is valid.

5. Device according to claim 2, wherein the first section of the first chamber comprises a bore, which contains a twisting insert at its end upstream of the position where the thread is sucked in .

6. Device according to claim 2, wherein the first section of the first chamber comprises a bore, which contains an insert on its end upstream of the position where the thread is sucked in, in which at least two smaller bores are arranged, wherein none of the axes of these smaller bores is coplanar with the axis of the large bore.

7. Device according to claim 1, wherein the compression chamber has a length of 30 to 300 mm and an internal diameter of 2.5 to 10 mm.

8. Device according to claim 1, wherein the compression chamber is formed from circular cylindrical rods preferably made of metal having a diameter of 1 to 3 mm, which are arranged equidistant of the point of fixture, wherein the interval between each two adjacent rods on the point of fixture is 0.2 to 1.5 mm.

9. Device according to claim 1, wherein the rods which form the compression chamber are fixed in such a way that they lie on the surface of a right circular truncated cone, wherein the angle of the surface relative to the base is greater than 80°.

10. Device according to claim 1, wherein the rods forming the compression chamber are elastically bent under the pressure of the yarn plug, whereby the yarn plug is produced at practically constant pressure and the position of the plug end remains fixed.

11. Device according to claim 1, wherein the compression chamber is formed from rods with two different lengths *e* and *k*, wherein a longer (*e*) and a shorter (*k*) rod follow alternatively and the relationship $2 \leqq (e/k) \leqq 50$ is valid for the ratio $(e/k)$.

* * * * *